US005337770A

United States Patent [19]

Wang

[11] Patent Number: 5,337,770

[45] Date of Patent: Aug. 16, 1994

[54] COLLAPSIBLE UMBRELLA

[75] Inventor: Max S. Wang, Taichung Hsien, Taiwan

[73] Assignee: Kortenbach Verwaltungs-Und Beteiligungsgesellschaft mbH and Company, Fed. Rep. of Germany

[21] Appl. No.: 112,528

[22] Filed: Aug. 27, 1993

[30] Foreign Application Priority Data

Feb. 6, 1993 [DE] Fed. Rep. of Germany ..... 4303527

[51] Int. Cl.[5] ..... A45B 19/00

[52] U.S. Cl. ..... 135/25.3; 135/29; 135/31

[58] Field of Search ..... 135/25.1, 25.3, 25.31, 135/26, 29, 31, 30

[56] References Cited

U.S. PATENT DOCUMENTS

| | | | |
|---|---|---|---|
| 2,156,984 | 5/1939 | Haupt | 135/26 |
| 3,901,257 | 8/1975 | Schafer | 135/25.3 |
| 4,739,783 | 4/1988 | Yang | 135/25 |
| 5,063,953 | 11/1991 | Wu | 135/25.3 |
| 5,235,998 | 8/1993 | Liu | 135/25.3 |

FOREIGN PATENT DOCUMENTS

| | | | |
|---|---|---|---|
| 823325 | 12/1951 | Fed. Rep. of Germany . | |
| 2219765 | 10/1973 | Fed. Rep. of Germany | 135/27 |
| 1-92816 | 6/1989 | Japan . | |
| 1-89015 | 12/1989 | Japan . | |

*Primary Examiner*—Carl D. Friedman
*Assistant Examiner*—Lan C. Mai
*Attorney, Agent, or Firm*—Samuel Meerkreebs

[57] ABSTRACT

The invention relates to a collapsible umbrella having a canopy frame which is collapsible in an at least four-fold manner and a stick (1) which is telescopic in an at least four-stage manner as well as a slide (2) displaceable on this said stick for canopy opening and closing, the canopy linkage comprising a combination of link parallelograms (I, II, III) or lever formations, which is formed from a combination of hollow, U-shaped, flat and round-profiled rod material. In order to make the folded-together umbrella as compact as possible in its cross-section, the invention provides that all the link parallelograms insert into one another so completely, with optimum utilization of the available cavities of the U-profiled canopy rods, that there are no unused empty spaces in the folding bends (K1, K2, K3, K4) of the folded-together formation (FIG. 1).

4 Claims, 2 Drawing Sheets

6-6

5-5

COLLAPSIBLE UMBRELLA

BACKGROUND OF THE INVENTION

1. Field of the Invention

The invention relates to readily collapsible, foldable, compact umbrellas.

In more detail, an umbrella having a canopy linkage which is collapsible in an at least four-fold manner and a stick which is telescopic in an at least four-stage manner, having a slide which is displaceable on the said stick for canopy opening and closing. The canopy linkage including in each case a main strut linked to the slide and a central canopy rod linked to the crown, as well as at least three collapsible link parallelograms which are controlled by means of this canopy rod and main strut, and in each case fold and extend peripheral outer canopy rods; all the parts of the canopy linkage comprising a combination of rods of U-shaped profiles, flat profiles and round profiles or wire profiles. To be precise, in such a mutual arrangement and alignment with respect to one another that, from the point of view of the collapsed umbrella, the main strut and the central canopy rod, as well as the upper long link of the first parallelogram are, in each case, formed by a U-shaped profile turned away from the stick axis and the upper long link of the second parallelogram as well as the lower long link of the third parallelogram, in each case, comprise a U-shaped profile turned towards the stick axis, whereas the lower long link of the second parallelogram and the upper long link of the third parallelogram, in each case, comprise a flat profile or round profile, the U-shaped profile of the central canopy rod being wider than the U-shaped profile of the upper long link of the first parallelogram and of the U-shaped profile of the main strut.

2. Description of Related Art

Umbrellas which are collapsible in a four-fold manner have been known in different variants, with different canopy kinematics, such as for example according to the variants defined above in accordance with U.S. patent Yang U.S. Pat. No. 4,739,783 or such as for example according to German Patent Specification 823,326 which shows crossing scissor levers and link parallelograms of flat bars. Umbrellas of these types can be optimally shortened to a pocket-sized configuration, while retaining an optimally large-area canopy parabola, since the canopy rods can be shortened to a quarter of their extended length.

Since however, in the collapsed state, the canopy rods inevitably produce an "accordion" folding, this folding is so obtrusive in the cross-section of the umbrella that it forms and appears as a relatively thick formation, in particular whenever, for reasons of better wind resistance, the canopy linkage is formed not just only from flat bars as in the case of the variant in accordance with German Patent Specification 823,325, but at least partially also from stabilising U-shaped profile material corresponding for instance to the variant in accordance with U.S. Pat. No. 4,739,783.

In order to make the canopy linkage of this variant, comprising U-shaped profile and round or wire profile, more slender in the folded-together state, already in this case, the link parallelograms fold substantially with the hollow profile spaces inserting or overlapping into one another, but in such a way that a relatively large empty space for a possible complete folding into one another of the canopy rods remains unused, in particular in the region of the crown between the central canopy rod and the first link parallelograms as well as in the region of the slide between the main strut and the second link parallelogram.

SUMMARY OF THE INVENTION

The object of the invention is to eliminate the drawbacks of the prior art, in the case of a collapsible umbrella of the types described above, consequently in this way to make a collapsible umbrella having a canopy linkage which is collapsible in an at least four-fold manner and is formed from various rod profiles even more optimally slender in the collapsed state, without, at the same time sacrificing the wind resistance of the umbrella canopy.

According to the invention, this object is achieved by the main strut being embraced by a forking or bifurcation, forming the short, inner link arm of the first parallelogram, and entering together with the upper long link of the first parallelogram into the central canopy rod, and by the U-shaped profile of the upper long link of the second parallelogram being wider than the U-shaped profiles of the main strut and of the last-mentioned upper link and of the flat profile of the lower long link of the second parallelogram,. Further the latter link also being thinner than the U-shaped profile of the main strut, so that the latter and the upper long link of the first parallelogram enter partially, and the lower long link of the second parallelogram enters completely in the upper long link of this parallelogram,. The connecting pivot joint, located in the forking of the central canopy rod, between the main strut and the central canopy rod entering into a recess of the lower long link of the second parallelogram and, accompanying this, the pivot joint connecting the last-mentioned link to the lower long link of the third parallelogram being displaced away from the stick axis in a slot guide assigned to the said joint.

By this measure, all the cavities of the U-shaped profiles of all the canopy rods are utilised optimally for inserting one into the other, without impairing the stable, wind-resistant structure of the profilings of the canopy rods. The canopy rod parts which are pressure-loaded generally have wider U-shaped profiles, into which the neighbouring more slender profiled parts can enter completely, to the base of the profiles, during the folding of the linkage on account of the predefined turning to and away of the U-shaped profiles, so that no open "accordion" folding bends remain unused between the foldings of the canopy linkage, for instance analogously to the umbrella folding in accordance with U.S. Pat. No. 4,739,783.

The cross-sectional volume thereby obtained, is more compact and makes the folded-together umbrella more slender, is further optimised by the connecting joint between the main strut and the central canopy rod entering into a recess of the lower long link of the second parallelogram, and the joint connecting this link to the lower long link of the third parallelogram shifting further away from the stick axis in the slot guide into the cavity of the last-mentioned link.

An advantageous development of the profile inserting of the canopy linkage according to the invention, as well as also at the same time the wind-resistant stabilising of the said linkage in the opened state, is a result of the lower long link of the third parallelogram incorporating on its short lever arm to the second parallelogram two U-shaped profiles of different widths, each having a fork-shaped projection, of which the first projection is made wide enough that it embraces the short lever arm of the upper long link of the second parallelogram together with the end of the upper long link of the third parallelogram, inset in the short lever arm, whereas the second fork-shaped projection is provided with the slot guide and is narrowed in its U-shaped profile with respect to the first fork-shaped projection in such a way that it embraces only the lower long link of the second parallelogram and, with opened canopy, enters into the downwardly open U-shaped profile of the upper long link of the second parallelogram, the joint in the slot guide entering with its rivet heads or eyelet flanges at both ends into recesses of the upper long link of the second parallelogram.

According to a further advantageous development variant of this profile inserting, the lever arm can enter with the second fork-shaped projection together with the joint and the slot guide, until, in a breakout or elongated opening of the U-shaped profile base of the long upper link of the second parallelogram, the breakout at the same time serving as a passage for the upper long link of the third parallelogram in the region of its connecting joint to the upper long link of the second parallelogram.

The invention is explained in more detail below with reference to an exemplary embodiment illustrated in

DETAILED DESCRIPTION

Figure 1:
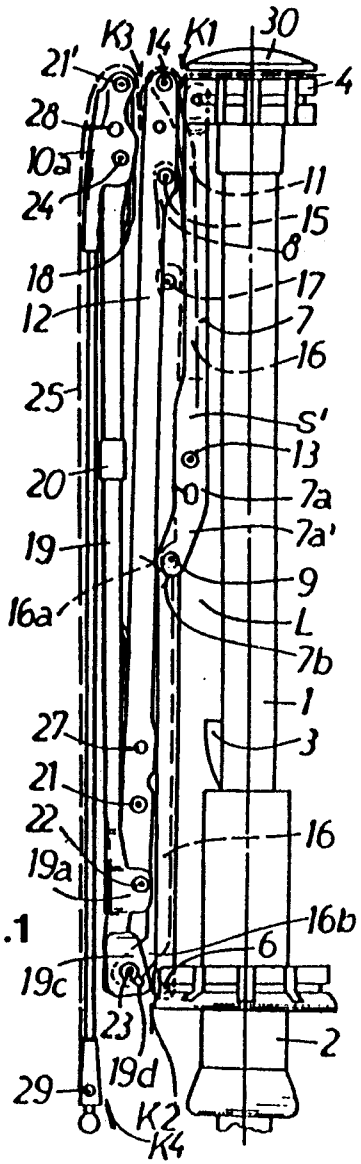
FIG. 1 is an elevational view of a collapsible umbrella in accordance with the invention; showing only one canopy linkage in detail, the canopy linkage being collapsed in the illustrated, four-fold manner.
Figure 2:
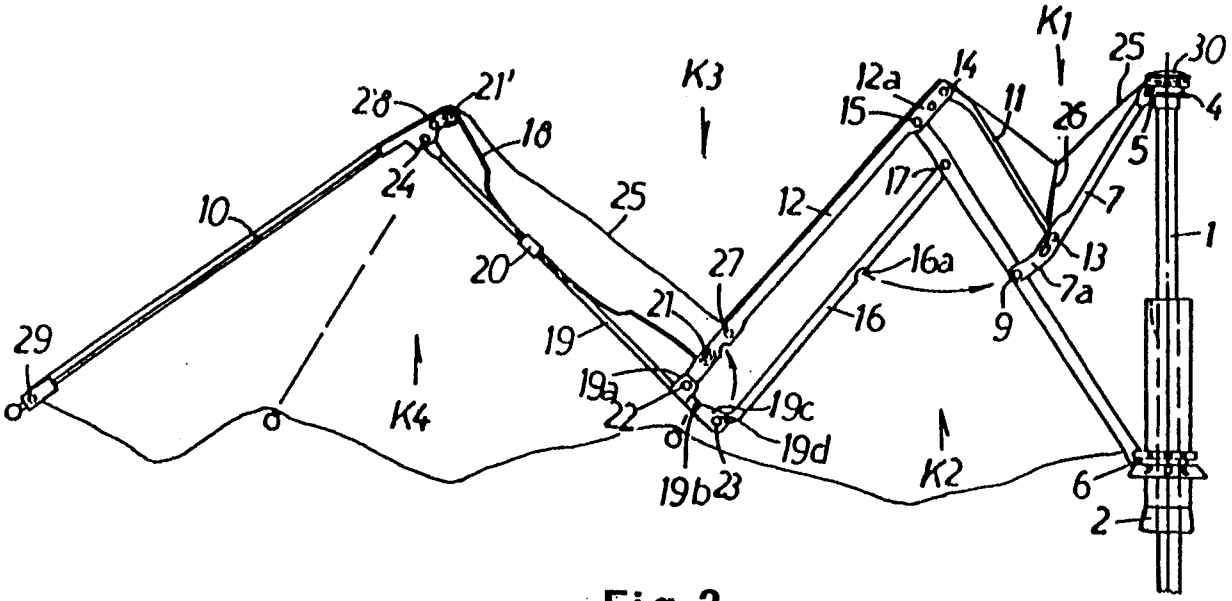
FIG. 2 is a reduced scale showing of the umbrella frame of FIG. 1 in a partially opened condition.
Figures 3, 4, 5, 6:
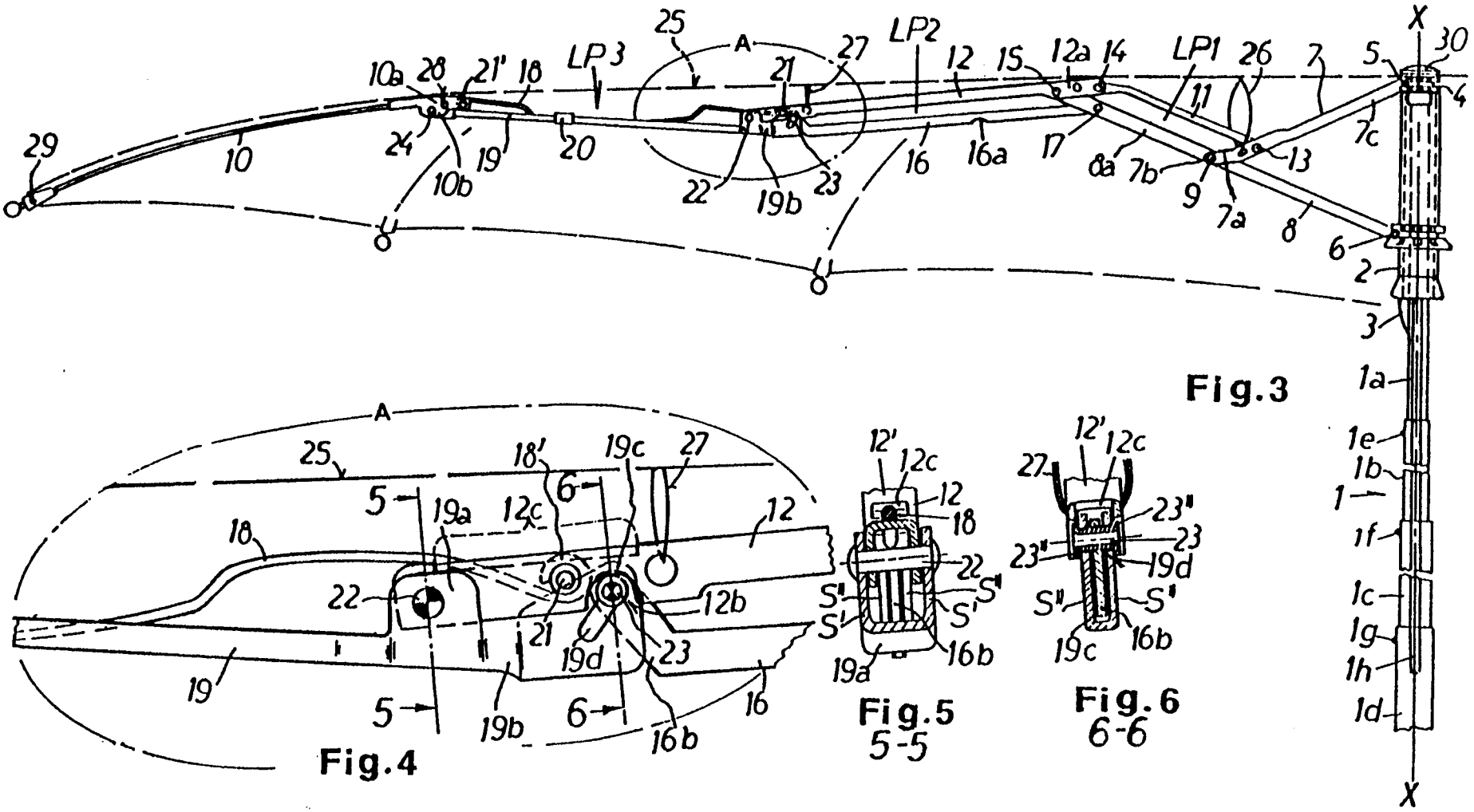
FIG. 3, shows the umbrella canopy linkage in its open or extended condition.
FIG. 4, is an enlarged fragmentary elevation of the at the area designated at "A" on FIG. 3.
FIG. 5 is an enlarged, sectional view taken of the plane of line 5—5 of FIG. 4.
FIG. 6 is an enlarged sectional view taken on the plane of line 6—6 of FIG. 4.

The umbrella according to the invention has a canopy linkage which can fold together in an at least four-fold manner, having at least three collapsible link parallelograms LP1, LP2, and LP3; these link parallelograms, together with canopy rods 10 form a four-fold, collapsible structure. For the sake of a more understandable and simplified description, these link parallelograms are described below by these reference designations. In adaptation to the dimension of the collapsed formation, the umbrella has a stick 1 which can be shortened in a four-stage manner, having four parts 1*a*, 1*b*, 1*c*, 1*d* which can telescope one into the other and can be arrested against one another in a known manner, as shown for example in Japanese patent No. 1-89015. A slide 2 for opening and closing the canopy is displaceable, along the longitudinal axis X, up and down on the stick 1, as seen in FIGS. 1–3. With an opened canopy, the slide can be fixed by an arresting means 3 (FIG. 3), which secures the slide 2 against movement in the downward direction and which is arranged on the part 1*a* of the stick 1. With closed canopy, the slide 2 assumes the position which can be seen from FIG. 1; i.e. at the lower end of the now-telescoped parts 1*a*, 1*b*, 1*c* and 1*d* of stick 1, close to the umbrella handle (not shown). For arresting the stick parts 1*a*, 1*b*, 1*c*, 1*d* against one another, spring catches 1*e*, 1*f*, 1*g*, known per se, may be used, which catches automatically engage during stick extension and disengage during stick retraction from the slide 2, for instance as described in the U.S. patent to Haupt U.S. Pat. No. 2,156,984. The conformal straight-straight guidance of the stick parts 1*a*, 1*b*, 1*c*, 1*d* may be ensured by a polygonal cross-sectional shape or, if round tubing is used, by means of a groove guide 1*h*, likewise known per se, as can be taken for example from JP-UM 1-92816 or 1-89015. The stick telescope may be arranged in such a way that the uppermost part 1*a* is the thinnest and the lowermost part 1*d* is the thickest, or vice versa. A crown 4 is fixed at the upper end of the stick 1. On this crown and on the slide 2, a plurality of canopy rod systems are linked all around in stellar form about axes of rotation 5 and 6, respectively. For the sake of better clarity, only one of these canopy rod systems is represented in each case. These exhibit in each case a central canopy rod 7, pivotable at the crown 4 about the axis 5, and a main strut 8, pivotable on the slide 2 about the axis 6. The said strut is connected in a rotationally movable manner to the central canopy rod 7 by a joint 9, the canopy rod 7, formed by a wide, stable U-shaped profile, embracing the main strut 8, comprising a more slender U-shaped profile, with a forking 7*a*. In this arrangement, the U-shaped profiles of both parts 7 and 8 are arranged and aligned in such a way that, with closed umbrella according to FIG. 1, they are turned away or open outwardly away from the longitudinal axis X of the stick 1 with their cavities or U-shaped legs S, S.

By means of the slide 2, the main strut 8 and the central canopy rod 7, LP1, LP2, LP3, and a peripheral canopy rod 10 hinged to LP4 are controlled in a collapsing movable manner, four folding forces or bends K1, K2, K3 and K4 being obtained within the respective canopy rod system during collapsing (FIG. 2). The long links of LP1 are formed by one section 8*a* of the main strut 8 and by a link 11, whereas the fork 7*a* of the central canopy rod 7 and a lever arm 12*a* of LP2, adjoining LP1, form the short links of LP1. The link 11 comprises a U-shaped profile which, like the U-shaped profiles of the central canopy rod 7 and of the main strut 8, faces or opens away from the stick axis X with the umbrella folded together, but is more slender in cross-section than the U-shaped profile of the central canopy rod 7. The latter is connected in its forking or bifurcation 7*a* via a hinge joint 13 to the long link 11 and the latter in turn acts via a hinge joint 14 on the lever arm 12*a*. A joint 15 connects this lever arm 12*a* to the section 8*a* of the main strut 8. The forking 7*a* extends from the fork end 7*b* continuously to beyond the hinge joint 13 and has the form of a curvature turning away from the stick axis X. This curved forking 7*a* exhibits, furthermore, wider flanks S', S' than the straight section 7*c* of the central canopy rod 7. Due to the curvature of the forking 7*a*, the hinge joint 9 arranged therein appears offset slightly outwards, away from the stick axis X, in comparison with the hinge joint 13, likewise embedded therein, with the folded-together clustering according to FIG. 1. On account of this constellation and U-shaped profile alignments and width dimensions, during folding together of the umbrella the long link 11 is inserted completely into the U-shaped profiles of the short lever arm 12*a* and of the central canopy rod 7. The long link (section 8*a*) enters into the short link formed by the forking 7*a* and, moreover, the main strut 8 and the central canopy rod 7 come to lie completely parallel to each other, without open "accordion" gussets, the central canopy rod 7 and the long link 11 inserted in it finding entry in the empty space L close to the stick, in the canopy opening space Z serves as displacing space for the slide 2.

LP1 is adjoined by LP2 with an upper long link 12 and a lower long link 16. The link 12 is linked to the hinge joint 15 on the main strut 8 and engages over the latter at this hinge joint 15 and with a wider U-shaped profile. The link 16 has a flat profile rectangular cross section; see FIGS. 5 and 6, which is thinner than the U-shaped profile of the main strut 8. Therefore, the latter embraces the link 16 at the connecting hinge joint 17. With collapsed canopy, the U-shaped profile of the long link 12 is turned with its cavity towards the stick axis X and, since the U-shaped profile of the main strut 8 is turned away from the stick axis X, the upper sections of the link 11 and of the main strut 8 are inserted in the U-shaped profile of the link 12 of LP2, and the parallel link 16 of the latter enters completely in the U-shaped profile of the main strut 8. The complexity of LP1 and LP2 thus inserted in one another is further increased by the link 16 to a certain extent engaging with a recess 16*a* with the hinge joint 9, located in the forking 7*a*, of the central canopy rod 7 see FIG. 1.

The third LP3 exhibits a long upper link 18 of round profile or flexible wire and a long lower link 19 having a U-shaped profile. With closed canopy (FIG. 1), said U profile is turned with its cavity towards the stick axis X and guides the upper link 18 in it with the aid of a collar 20 enclosing both links 18 and 19. The upper link 18 is connected by eyelet-shaped bends 18' FIG. 4 at both ends, on the one hand via a hinge joint 21 to the upper long link 12 of LP2 and on the other hand via a hinge joint 21' to the short lever arm 10*a* of the peripheral canopy rod 10. The lower long link 19 has a U-shaped profile of different width. At the hinge joint 22, connected to the upper long link 12 of LP2, the link 19 embraces the link 12 with a wide, fork-shaped projection 19*a* and, at the end of its short lever arm 19*b*, it embraces the lower long link 16 of LP2 with a narrowed, more slender U-shaped profile and a projection 19*c* formed thereupon. The said projection has a slot guide 19*d*, in which a connecting hinge joint 23 between the lever arm 19*b* and the long lower link 16 of LP2 is displaceably guided. The end of the lever arm 19*b*, provided with the projection 19*c*, is narrowed in its U-shaped profiling in such a way that in it only the flat-profiled link 16 with a bent-off end 19*b* is rotationally displaceable and thinner than the U-shaped profile of the upper long link 12 of LP2 see FIG. 6. As a result, the lower long link 19 of LP3 can, in the folded-together state of the canopy (FIG. 1), allow the long parallel upper link 18 and the lower ends of the links 12 and 16 to enter into its hollow profile, but at the same time also in the opened state of the canopy (FIGS. 3, 4) enter with the fork-shaped projection 19*c* as well as together with the angled-off end 16*b* of the link 16 in the cavity of the upper long link 12 of LP2, with accompanying displacement of the hinge joint 23 in the slot guide 19*d*. In this way, an advantageous dual effect is obtained in one, a compact inserting of the canopy rods in the folding bend K3 with closed canopy and a significant improvement in its wind resistance with opened canopy. The depth of entry of the projection 19*c*, of the displaceable hinge joints 23 and of the end 16*b* of the link 16 into the link 12 can be determined and extended by recesses 12*b* in the U-shaped profile legs S'S' and S''S'. The depth of entry may reach into a breakout or slot-opening 12*c* which is punched out from the base 12'' of the U-shaped profile of the link 12 and may at the same time be as a passage for the flexible wire link 18 to its hinge joint 21 as seen in FIGS. 4, 5 and 6.

With its rivet heads or eyelet flanges 23', 23'' at both ends, the hinge joint 23 can effect the depth-stop of the parts 16, 19*b*. On the other hand, with the collapsed canopy, the slot guide 19*d* of the hinge joint 23 has the effect that the hinge joint 23 is displaced away from the stick axis . X, that is further into the available cavities of the linkage, with the bent-off end of the long lower link 16 of LP2, so that these cavities can be optimally utilised for the compact formation.

With its outer end, the lower long link 19 of LP3 is connected by a hinge joint 24 to the peripheral canopy rod 10. In this arrangement, the latter embraces the long link 19 with a deep-drawn U-shaped forking 10*a* in such a way that, with closed canopy (FIG. 1), the said forking receives in it the outer ends of the links 18 and 19. The canopy cover 25 is fastened to the canopy linkage by means of sewing threads 26, 27, 28, 29 in such a way that it is also drawn into the folding bends K1 and K3 during collapsing of the canopy. In the folded-together state of the canopy, the canopy cover 25 is therefore folded narrowly into the canopy structure described above in the region of these folding bends. The folded-together canopy structure is in this case so optimally compact that no open or empty folding gussets or open "accordion" folds occur and consequently the folded-together umbrella appears as an optimally slender, pocket-sized formation. In the centre of the canopy, the canopy cover 25 is fixed to the crown 4 by a cap 30.

| List of reference designations | |
|---|---|
| 1 | Stick |
| 1a | Stick part |
| 1b | Stick part |
| 1c | Stick part |
| 1d | Stick part |
| 1e | Spring catch |
| 1f | Spring catch |
| 1g | Spring catch |
| 1h | Groove guides |
| 2 | Slide |
| 3 | Arrestings means on 1 |
| 4 | Crown on 1 |
| 5 | Axis of rotation of 7 |
| 6 | Axis of rotation of 8 |
| 7 | Central canopy rod |
| 7a | Forking/lever arm |
| 7b | Fork end |
| 7c | Straight section |
| 8 | Main strut (U profile) |
| 8a | lower, long link of LP1 |
| 9 | Joint of 7 on 8 |
| 10 | Peripheral canopy rod |
| 10a | Short lever arm |
| 10b | Forking |
| 11 | Long upper link of LP1 |
| 12 | Long upper link of LP2 |
| 12a | Lever arm |
| 12b | Recesses |
| 12c | Breakout |
| 12* | Base of the U profile |
| 13 | Joint of 11 |

-continued

| List of reference designations | |
|---|---|
| 14 | Joint of 11 |
| 15 | Joint of 8 |
| 16 | Long lower link of LP2 |
| 16a | Recess |
| T | Flat profile |
| 16b | Bent-off end |
| 17 | Joint of 16 |
| 18 | Long upper link of LP3 |
| 18' | Eyelet-shaped windings |
| 19 | Long lower link of LP3 |
| 19a | Fork-shaped projection |
| 19b | Short lever arm |
| 19c | Fork-shaped projection |
| 19d | Slot guide |
| 20 | Collar on 19 |
| 21 | Joint of 18 on 12 |
| 21* | Joint of 18 on 10a |
| 22 | Joint of 19 on 12 |
| 23 | Joint of 19d |
| 23' | Rivet heads |
| 23" | Eyelet flanges |
| 24 | Joint of 10 on 19 |
| 25 | Canopy cover |
| 26 | Sewing thread |
| 27 | Sewing thread |
| 28 | Sewing thread |
| 29 | Sewing thread |
| 30 | Cap on 4 |
| K1 | Folding bend (FIGS. 1 + 2) |
| K2 | Folding bend |
| K3 | Folding bend |
| L | Empty space close to stick |
| LP1 | Link parallelogram I |
| LP2 | Link parallelogram II |
| LP3 | Link parallelogram III |
| S | U-profile leg |
| S', S" | Flanks of 19 |
| X | Stick axis |

I claim:

1. A collapsible umbrella comprising, in combination: an elongated sectional umbrella stick (1) having an upper crown (4) and a longitudinal axis (X);

said stick comprising at least four telescopic sections (1*a*, 1*b*, 1*c*, 1*d*), collapsible one into the other along said longitudinal axis;

an uppermost of said stick sections having manually-operable, slide-arresting means (3);

a manually-displaceable slide (2) on said stick for controlling operation of said umbrella from a compacted stored condition to an erected condition when support on said slide-arresting means;

a plurality of canopy rod systems disposed in stellar relation about said stick axis and operatively connected to said crown and said slide for relative pivotal movement with respect to said crown and slide in response to reciprocation of said slide along the longitudinal axis of said stick; and a canopy cover (25) mounted on said canopy rod systems and said crown for folding said unfolding with said canopy rod systems as said slide is manipulated, each of said canopy rod systems including a central canopy rod (7) pivotally connected (5) to said crown (4) and having a U-shaped cross section opening away from the longitudinal axis of said stick, when the umbrella is collapsed, a main strut (8) pivotally connected (6) at an inner end to said slide and having a U-shaped cross section opening away from said axis when the umbrella is collapsed, said central canopy rod having a bifurcated outer end portion (7*a*) overlapping an intermediate portion of said main strut and pivotally connected (9) at said intermediate portion, said canopy rod systems further comprising a series of at least three link parallelograms (LP1, LP2, LP3) and a peripheral canopy rod (10) successively disposed outwardly from said stick axis when the collapsible umbrella is erected and compactly foldable upon each other and said central canopy rod and said main strut (FIG. 1) when the umbrella is closed, the first of said link parallelograms (LP1), nearest said umbrella stick, comprising a first long link (11) terminally pivoted (13) at an inner end within the said central canopy rod (7) adjacent said bifurcated portion (7*a*) and defining a first short link (7*a*) of said first of said link parallelograms, said first long link having a U-shaped cross section having a width less than, the width of said canopy rod whereby the first long link (11) is received therein (7) when the umbrella is collapsed, said first link parallelogram (LP1) including a second long link (8*a*), parallel to said first long link (11) and extending from the pivotal connection (9) of the bifurcated portion (7*a*) to the terminal end (15) of said main strut, the second link parallelogram (LP2) comprising a first, upper long link (12) having a U-shaped cross section opening toward said stick axis, when the umbrella is closed, and pivotally receiving the terminal end (15) of main strut (8) therein and defining a second short link (12*a*) of said first link parallelogram, said second link parallelogram including a lower, long link (16) having a relatively thin cross section (FIGS. 1, 5 and 6) for substantial receipt in said main strut (8) when the umbrella is collapsed, said lower long link (16) of said second link parallelogram (LP2) being terminally pivoted (17) at its upper end within an intermediate portion of said main strut (8) and defining thereabove a first short link of said second link parallelogram, the third link parallelogram (LP3) comprising an upper, long link (18) terminally pivoted (21) at an inner end within an intermediate portion of the first, upper long link (12) of said second link parallelogram (LP2) and defining thereon an inner, first short link of said third link parallelogram, said third link parallelogram (LP3) having a second, lower long link (19) having a U-shaped cross section opening toward said stick axis when the umbrella is collapsed, and being intermediately pivoted (22) on the outer end of the upper, first long link (12) of said second link parallelogram and defining thereon an inner short link of said third link parallelogram, said peripheral canopy rod being intermediately pivoted (24) to the outer end of the lower long link (19) of said third link parallelogram and terminally pivoted at its inner end (21') to the outer end of an upper long link (18) of the third link parallelogram and defining between the pivotal connections (24, 21') an outer short link (28) of said third link parallelogram, the upper long link (18) of the third link parallelogram being substantially disposed within the lower long link (19) of said third link parallelogram and being pivotally connected at an inner end (21) to an intermediate portion of the upper long link and defining the inner, short link of the third link parallelogram, whereby the upper long link (18) is substantially compressed between the upper long link of the second link parallelogram and the lower long link of said third link parallelogram when the umbrella canopy rod systems are simultaneously operated through manipulation of said slide below the slide-arresting means (3) and the rod systems are caused to fold, with the canopy, in an accordion-like manner (FIG. 2) subject to alternating fold-forces (K1, K2, K3, K4) for forming alternate folds along the umbrella stick, the improvement characterized in that:

the upper long link (11) of the first link parallelogram is pivotal substantially into the central canopy rod (7) when disposed parallel thereto, the upper long link (12) of the second link parallelogram is wider than the main strut (8) and the relatively thin lower long link (16) of the second link parallelogram, said lower long link (16) being pivotal substantially into the main strut (8) and the upper long link (12) of the second link parallelogram, said lower, thin long link (16) of the second link parallelogram having a lower recess portion (16*a*) alignable with and receiving therein the pivotal connection (9) of the bifurcated end portion (7*a*) of the central canopy rod (7) when the umbrella is closed, the lower long link (19) inner bifurcated (19*a*) of the third link parallelogram having a transverse guide slot (19*d*) reciprocatingly receiving the outer pivotal connection (23) of the lower long link (16) of the second link parallelogram for permitting relative reciprocation of the pivotal connection (23) with respect to the upper long link (12) of the second link parallelogram during opening of the umbrella whereby the opened umbrella is substantially stabilized and compacted when closed.

2. The structure as claimed in claim 1 in which the lower long (16) of the second link parallelogram has a thin, rectangular cross section (FIGS. 2, 5 and 6) whereby the umbrella frame is stabilized when open and whereby the closed umbrella is compact when the lower long link (16) is sandwiched within oppositely-opened top long link (12) of the second link parallelogram (LP2) and the main strut (8).

3. The structure as claimed in claim 2 in which the upper long link (12) of the second link parallelogram has a downwardly opening recess (12*b*) for receiving therein the pivotal connection (23) of the bifurcation (19*b*) at the outer end of the lower long link (16) of the second link parallelogram.

4. The structure as claimed in claim 3 in which the inner bifurcation (19*b*) comprises two U-shaped different-width portions (S', S''; see FIGS. 4–6), the first U-shaped portion (S') flanking and being pivotally connected (22) to the outer end of upper long link (12) of the second link parallelogram, said other U-shaped portion (S'') of said bifurcation (19*b*) snugly embracing (FIG. 6) the outer end of the lower long link (16) of the second link parallelogram for providing improved wind resistance when the umbrella is open and a compact slim package when the umbrella is closed.

* * * * *